US008453747B2

(12) United States Patent
Holm

(10) Patent No.: US 8,453,747 B2
(45) Date of Patent: Jun. 4, 2013

(54) METHOD FOR LIQUID CONTROL IN MULTIPHASE FLUID PIPELINES

(75) Inventor: Henning Holm, Oslo (NO)

(73) Assignee: Statoilhydro ASA, Stavanger (NO)

( * ) Notice: Subject to any disclaimer, the term of this patent is extended or adjusted under 35 U.S.C. 154(b) by 553 days.

(21) Appl. No.: 12/599,862

(22) PCT Filed: Apr. 28, 2008

(86) PCT No.: PCT/NO2008/000150

§ 371 (c)(1),
(2), (4) Date: Feb. 9, 2010

(87) PCT Pub. No.: WO2008/140319

PCT Pub. Date: Nov. 20, 2008

(65) Prior Publication Data

US 2010/0155075 A1 Jun. 24, 2010

(30) Foreign Application Priority Data

May 16, 2007 (NO) ..... 20072523

(51) Int. Cl.
*E21B 43/34* (2006.01)
*E21B 43/40* (2006.01)

(52) U.S. Cl.
USPC ..... 166/357; 166/344; 166/345

(58) Field of Classification Search
USPC ..... 166/357, 344, 345, 367, 265, 335, 166/341, 342
See application file for complete search history.

(56) References Cited

U.S. PATENT DOCUMENTS

| | | | | |
|---|---|---|---|---|
| 4,708,793 | A * | 11/1987 | Cathriner et al. | 210/188 |
| 5,232,475 | A * | 8/1993 | Jepson | 95/260 |
| 5,288,312 | A | 2/1994 | Payne et al. | |
| 5,794,700 | A * | 8/1998 | Pollack | 166/339 |
| 6,079,498 | A * | 6/2000 | Lima et al. | 166/370 |
| 6,390,114 | B1 * | 5/2002 | Haandrikman et al. | 137/2 |
| 7,013,978 | B2 * | 3/2006 | Appleford et al. | 166/357 |
| 2006/0162553 | A1 | 7/2006 | Esparza et al. | |

FOREIGN PATENT DOCUMENTS

| | | |
|---|---|---|
| EP | 1540136 B1 | 3/2006 |
| GB | 2282399 | 4/1995 |
| WO | 8701759 | 3/1987 |
| WO | 03067146 | 8/2003 |
| WO | 2006098637 | 9/2006 |

* cited by examiner

*Primary Examiner* — Thomas Beach
*Assistant Examiner* — James Sayre
(74) *Attorney, Agent, or Firm* — Volpe and Koenig, P.C.

(57) ABSTRACT

A method for control of liquid or liquid slugs in multi phase fluid pipelines, including a multiphase pipeline for the transportation of a fluid, consisting of mainly gas and some liquid such as water an/or gas condensate. The gas is evacuated via a gas separation unit connected to the multiphase pipeline to a second gas transport pipe, and the liquid is fed to a dedicated pipeline section acting as a buffer volume pipeline. The separation unit includes one or several vertical pipes connected at a distance from one another along the multiphase pipeline, whereby the gas is transported separately to a downstream processing facility on a platform or onshore or the like, and whereby the liquid proceeds to the loop which may preferably be an extension of the multiphase pipeline, or the liquid and gas may be re-combined and led in a common transport pipeline to the desired destination.

11 Claims, 4 Drawing Sheets

METHOD FOR LIQUID CONTROL IN MULTIPHASE FLUID PIPELINES

FIELD OF INVENTION

The present invention relates to a method for the control of transient liquid flow or liquid slugs in multi phase fluid pipelines.

BACKGROUND

When transporting a fluid containing both gas and liquid over longer distances such as when transporting unprocessed or partly processed well fluid from an off-shore production system to an on-shore processing facility, or when transporting unprocessed or partly processed well fluid from on off-shore production system to a platform processing facility, transient liquid flow or liquid slugs partly containing hydrocarbons (condensate and oil) and/or water tend to be created in the pipeline either due to seabed terrain effects, and/or transient operation of the pipeline. The liquid in the fluid flow of the pipeline will, depending on the velocity of the fluid, tend to accumulate in the pipeline. At high velocities the liquid will continuously be transported together with the gas. On the other hand, with lower velocities the liquid will accumulate at the uphill parts of the pipeline as mentioned above. As the velocities are increased the accumulated liquid will be disposed from the pipeline into the downstream facilities either as liquid slugs or liquid surges. Such liquid slugs or surges may exceed the liquid handling capacity of the downstream processing facilities and cause operational problems, and may, at high velocities, cause sever damage to the process equipment being connected to the downstream end of the pipeline.

Different types of slug catchers are previously known which are designed to deal with slugs in multiphase flow pipelines. One type which is commonly used is the so-called finger-type slug catcher consisting of multiple parallel pipes being connected to a common unit and which is capable receiving and buffer an arriving slug. Such known slug catcher is, however, very heavy, large and space consuming and therefore represent a very expensive solution when used on onshore or at off-shore platforms as the platforms must be specially designed for such heavy and spacey piece of equipment.

WO 03/067146 A1 relates to a sub sea multiphase pipeline with integrated slug-catcher where the sub sea pipeline comprises at least one section with a tendency to the formation of slugs at a multiphase flow in an upward slope, and where at a low point in said section is provided at least one downwards directed branch being connected to a second pipeline to enable separation of liquid from such lower point in the sub sea pipeline to the second pipeline.

One major disadvantage with this known solution is that it will not enable sufficiently speedy separation of fluid of slugs containing large amounts of liquid, whereby the slugs will pass by, and proceed further downstream of the separation point.

SUMMARY

With the present invention a method for the control of liquid surges or liquid slugs in multi phase fluid pipelines or pipe systems is provided which is not encumbered with the above disadvantages, i.e. which provides optimum control of liquid surges or liquid slugs in the multiphase pipeline, which is simple and requires no or minimum space onshore or on the platform and which is cheap and safe in operation. A preferred feature of the invention is to use standard pipeline equipment as the liquid buffer volume, enabling buffer volumes by use of simple equipment.

According to the present invention a liquid slug is evacuated into a buffer volume. After receipt of a liquid slug the buffer volume should be drained to free the buffer volume at least to such an extent that it has the capacity to receive the next liquid slug.

The evacuation of the buffer volume may be performed in different ways. The liquid may be driven out from the lowest point by the pressure in the pipeline. At normal conditions, which mean no slug, a slip stream may be passed through the buffer volume to keep it empty.

Alternatively the slug catcher may be evacuated by "dynamic pigging", that is to say by leading the gas stream through the slug catcher thereby forcing the liquid out. At normal conditions a slip stream can by applied to keep the buffer volume empty.

Another alternative is to use of traditional pigging.

BRIEF DESCRIPTION OF THE DRAWINGS

The invention will be further described in the following by way of example and with reference to the drawings in which.

DETAILED DESCRIPTION OF THE PREFERRED EMBODIMENTS

Figure 1:
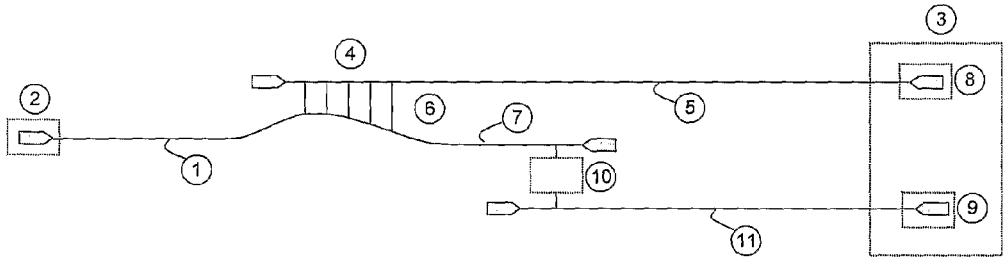
FIG. 1 shows a principle sketch of the invention.
Figure 2:
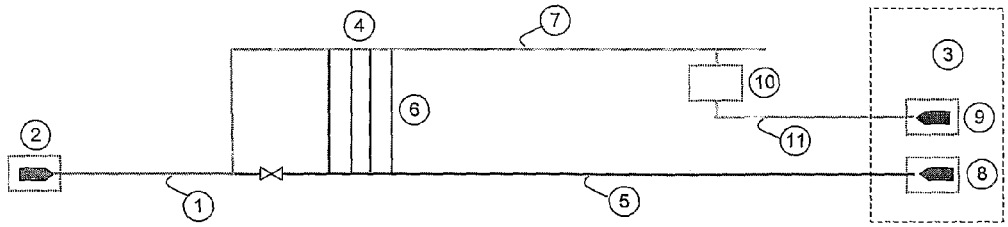
FIG. 2 shows a variation of the embodiment shown in FIG. 1.

A principal sketch of the system arrangement according to which the method of the invention is based is, as stated above, shown in FIG. 1 and FIG. 2.

When interpreting the figures it is of outmost importance to understand that they only show the principle of the invention and not details of the installations such as a platform or a process site on shore in connection with which the method, or system arrangement, valves or controls.

Fluid in the form of gas containing liquid such as condensate and water is transported in a multiphase pipeline 1 from an upstream site 2, for instance from a sub sea production system or a minimum processing platform, to a downstream site 3 such as a processing facility located on another platform or onshore. The pipeline 1 may be several (hundred) kilometer long and may be provided on the sea floor. The key features of the invention is the provision of a gas separation unit 4 which is connected to the multiphase pipeline 1 to separate (extract) the gas from the multiphase pipeline 1 to second gas transport pipe 5, which may or may not be the same diameter as the multiphase pipeline 1, and a dedicated pipeline section acting as a slug catcher (buffer volume pipeline) 7 which in this embodiment is provided as a continued part of the multiphase pipeline 1. The gas separation unit includes one or preferably several vertical or inclined pipes 6 connected at a distance from one another along the multiphase pipeline. The gas is thus transported separately to a gas destination 3, whereas the liquid proceeds to the buffer volume pipeline 7 which may preferably be an extension of the multiphase pipeline 1 or a third pipeline connected to the multiphase pipeline 1 and having possibly a different diameter. The buffer volume pipeline 7, which may be several kilometer long depending on the size of the slug or quantity of liquid to be expected, represents a buffer receiver designed to entrap (hold) a quantity of liquid which is in excess of the quantity of liquid being present in such expected slug or the liquid arriving with the gas. The gas in the gas pipe 5 may be led to a high pressure destination 8, whereas the liquid may be led to a low pressure destination 9 in a controlled way through a control device 10 via a separate liquid pipe line 11 to the liquid destination, or the liquid and gas may be re-combined and led in a common transport pipeline to the desired destination. The gas and liquid destination may or may not be at the same location. Further the gas and liquid destination may or may not be operated at equal pressure. The control device 10 may be a pressure reduction device (valve or choke) or a pressure boost device such as a pump. The function of the control device is to secure the emptying of the buffer volume pipeline 7 after it has received of a slug, so that the buffer capacity/slug catching capacity is restored. With the present invention as described above in conjunction with FIG. 1, is thus provided a method and system arrangement by which a multiphase fluid in the form of gas and liquid is handled in a safe and controlled manner where the gas is separated from the liquid and transported to a process site or the like, and whereas the liquid which may arrive in the form of slugs and/or in continuous or discontinuous manner, is fed from the buffer volume pipe 7 at a controlled flow rate to a selected down stream processing or receiver/storage arrangement. The greyish boxes P at the end of each pipeline in FIG. 1 and later figures relates to a pig launcher or pig receiver, indicating that the pipelines included in the method and system arrangement according to the present invention may be fully cleaned by a pigging arrangement, representing an important advantage with the present invention.

FIG. 2 shows a variation of the embodiment illustrated on FIG. 1. FIG. 2 illustrates the arrangement seen from above. Here the dedicated pipeline section acting as a slug catcher (buffer volume pipeline) 7 is provided as a continued part of the other pipeline. In this alternative the well fluid is routed to the other pipeline via a Tee and back into the continuation of the main pipeline via the gas separation unit 4. The gas separation unit comprises U formed pipelines with a first mainly vertical section connected to the other pipeline, a mainly horizontal part and a vertical part connected to main pipeline. The valve in the main pipeline placed upstream of the Tee is closed during normal operations but can be opened in connection with pigging of the main pipeline.

Figure 3:
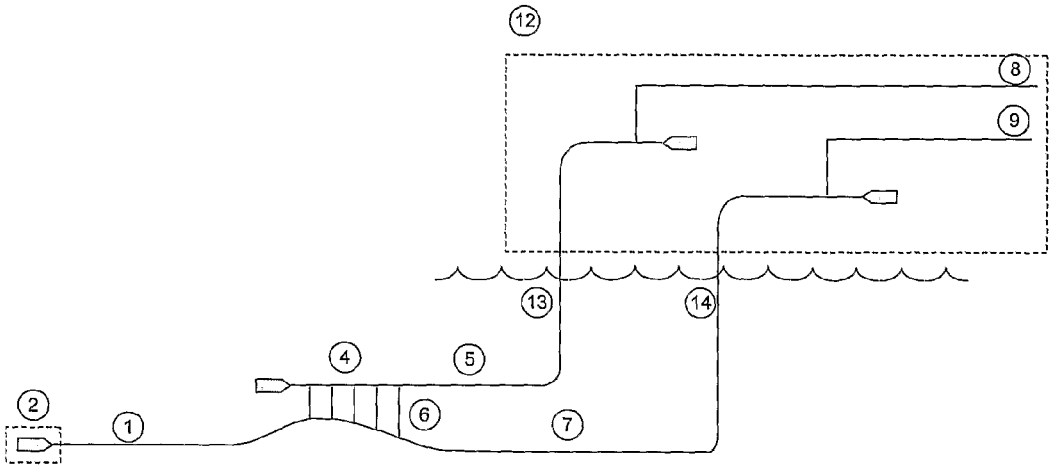
FIG. 3 shows a principle sketch of a second embodiment of the invention.

FIG. 3 shows another, second embodiment of the invention where fluid, as with the example in FIG. 1, in the form of gas containing liquid such as condensate and water is transported in a multiphase pipeline 1 from an upstream site 2, for instance from a sub sea production system or a minimum processing platform, to a downstream site 12 which in this case is a processing facility located on another platform or on-shore. In this example the gas separation unit 4 and buffer volume pipe 7 is provided on the sea bottom, whereas the gas and liquid is passed to the platform or onshore site 12 via gas riser pipeline 13 and liquid riser pipeline 14 respectively. With this solution the gas separation 4 and liquid or buffer volume pipe 7 is provided on the sea floor prior to (up streams of) the platform or onshore site 12 thereby avoiding the use of space consuming equipment on the platform or onshore. In this embodiment the buffer volume pipe 7 may be evacuated by a pigging, dynamic pigging or by use of a pump, and it may be kept "empty" by use of a slip stream.

Figure 4:
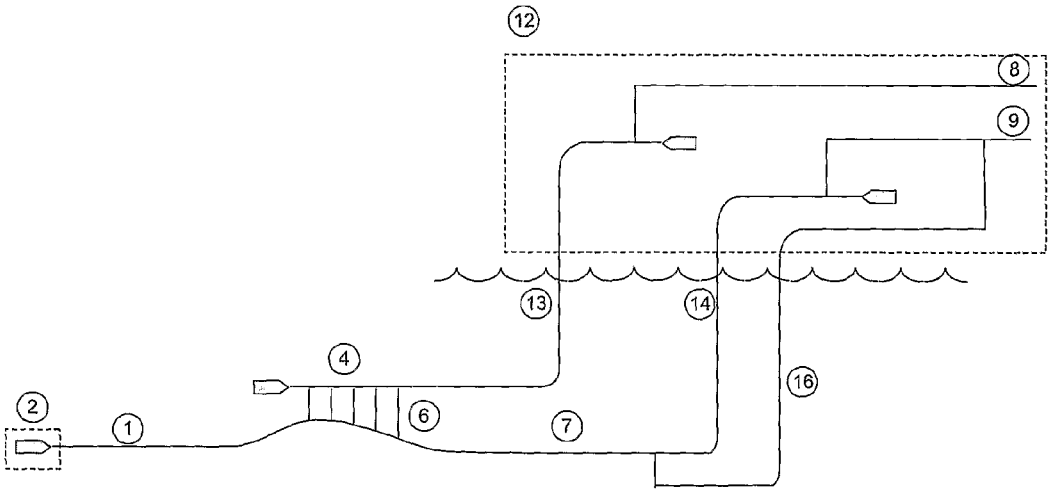
FIG. 4 shows a principle sketch of a third embodiment of the invention.

FIG. 4 shows a third embodiment of the invention based on the same solution as in FIG. 2, but where the liquid may be evacuated from the buffer volume pipe section 7 in a separate pipe line 16 to be transported separately to the liquid destination, or to be recombined with the gas through a recombination unit (not shown) before further transportation to the liquid/gas destination. In a preferred version of the third embodiment the line 16 is connected to the pipe 7 at the lowest point of buffer volume pipeline 7.

Figure 5:
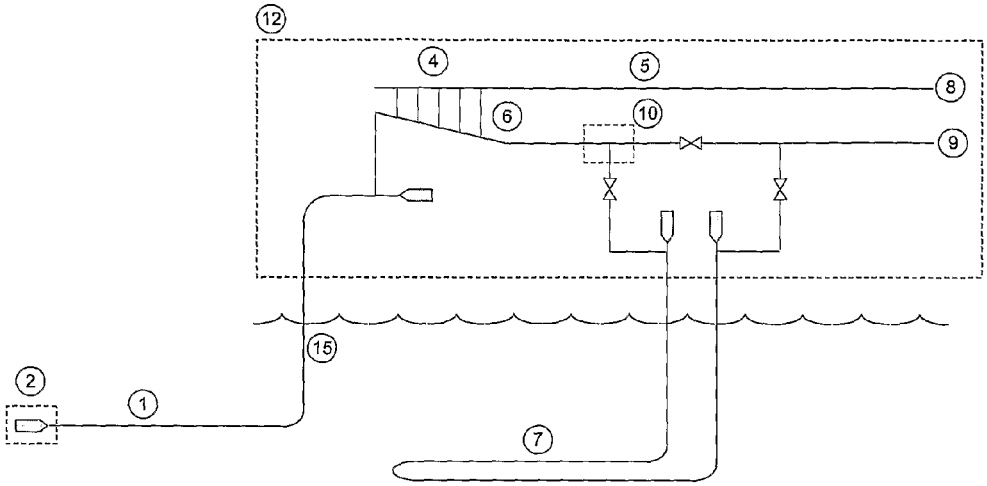
FIG. 5 shows a principle sketch of a fourth embodiment of the invention.

FIG. 5 shows a fourth embodiment of the invention where a fluid, as with the example in the FIGS. 2 and 3 above, is transported from an upstream site 2 through a transport pipeline 1 to a platform or on-shore site 12 via a riser 15. The gas is, in this example, separated from the liquid by gas separation unit 4 provided on the platform or on-shore site 12, while the liquid in case of a slug is evacuated to a buffer volume pipe loop 7 preferably provided on the sea floor. Optionally, the liquid may bypass the buffer volume pipe loop 7 during periods with low liquid loading. With this solution an arrangement is provided by which the gas/liquid separation is located in "dry" environment, while the space and weight demanding equipments, buffer volume pipe loop 7, is located sub-sea.

Figure 6:
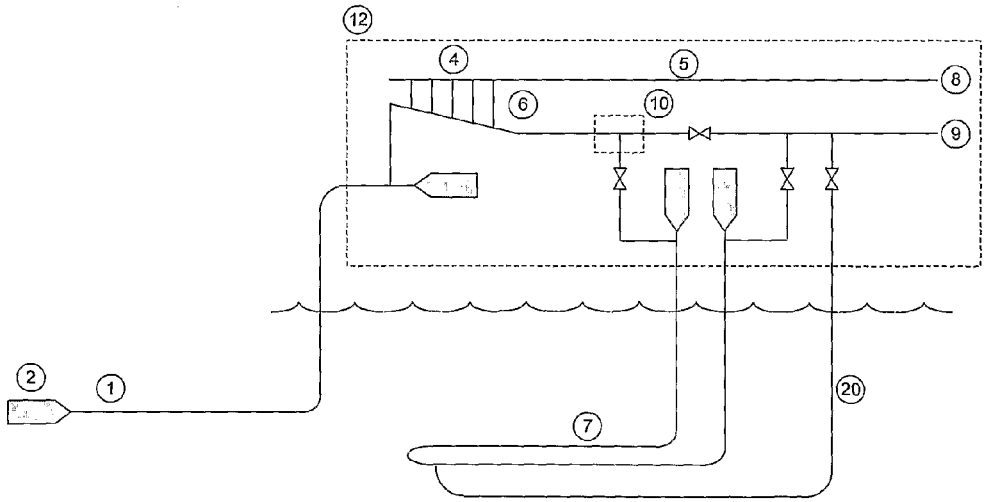
FIG. 6 shows a principle sketch of a fifth embodiment of the invention.

FIG. 6 shows a fifth embodiment of the invention corresponding to the solution according to FIG. 5 with the a buffer volume pipe loop 7 provided on the sea floor, but where the liquid is evacuated from the pipe loop 7 in a separate liquid evacuation pipe line 20, preferably connected to pipe loop 7 at a low point. With this solution is provided an arrangement by which a simplified drainage of the buffer volume pipe loop 7 is achieved.

Figure 7:
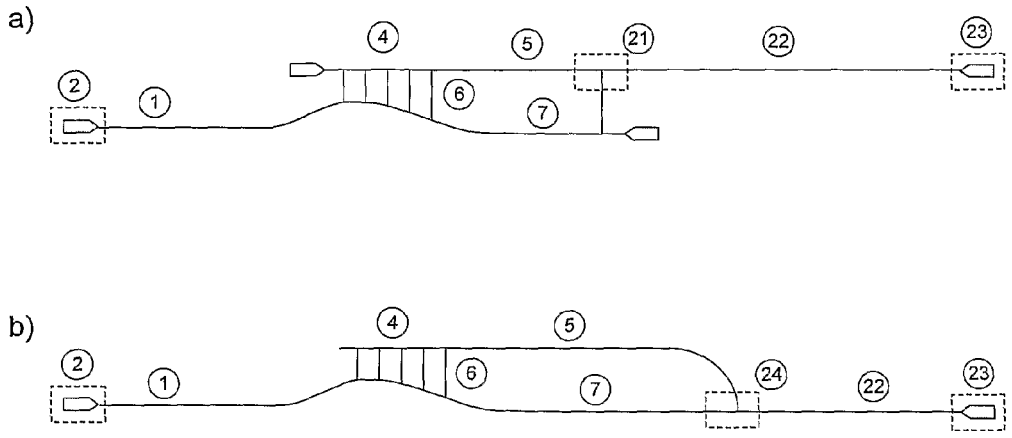
FIG. 7 shows a principle sketch of a sixth embodiment of the invention.

As stated above in conjunction with FIG. 1, the gas in the gas pipe 5 may be led to a high pressure destination 8, whereas the liquid may be led to a low pressure destination 9 in a controlled way through a control device 10 via a separate liquid pipe line 11 to the liquid destination, or the liquid and gas may be re-combined and led in a common transport pipeline to the desired destination. In fact, with all embodiments as shown in FIGS. 1-6 the liquid and gas, after being controlled by the method according to the present invention may be recombined and be transported in a common pipeline as shown in FIG. 7. Hence, FIG. 7 *a*) shows a solution where the liquid in a controlled manner is re-injected into the gas transport line 5 through a liquid control device 21 and is further transported in a common transport pipeline 22 to the desired destination 23. FIG. 7 *b*) shows a solution where the gas is re-injected into the liquid transport pipeline 24 and is further transported in a common transport pipeline 22 to the desired destination 23. The objective of the buffer volume pipe loop 7 in this embodiment is to stabilize the liquid flow before the gas and liquid is recombined.

The invention claimed is:

1. A method for the control of unstable liquid flow or liquid slugs in a multi phase fluid pipeline, comprising transporting a fluid consisting of mainly gas and some liquid including one or more of water and gas condensate to a gas separation unit including one or more vertical pipes connected at a distance from one another along the top of the multi phase fluid pipeline directly without any additional intermediate separation chamber to a second pipe for transporting the gas to a selected downstream processing site, evacuating the gas via the gas separation unit, allowing the liquid to proceed to a dedicated pipeline section which is a continued part of the multi phase fluid pipeline and acts as a buffer to entrap a quantity of liquid which is in excess of the quantity of liquid being present in the expected slug or liquid arriving with the gas in the multi phase liquid pipeline, and allowing the liquid to proceed from the dedicated pipeline section at a controlled flow rate to a desired destination and after receiving a slug the dedicated pipeline section is evacuated to restore buffer capacity.

2. The method according to claim 1, further comprising recombining the liquid and gas after the liquid has been evacuated from the dedicated pipeline section and led in a common transport pipeline to a desired destination.

3. The method according to claim 1, further comprising providing the gas separation unit and the dedicated pipeline section on the sea bottom, and passing the gas and liquid to a platform or an onshore site via a gas riser or pipeline and a liquid riser or pipeline respectively.

4. The method according to claim 1, further comprising evacuating the liquid from the dedicated pipeline section in a separate pipeline and transporting it separately to the desired destination, wherein the desired destination is a liquid destination.

5. The method according to claim 1, wherein the gas separation unit is provided on a platform or an on-shore site, while the liquid is evacuated to a buffer volume pipe loop, which is an extension of the multi phase fluid pipeline, or the liquid bypasses the buffer volume pipe loop during periods with low liquid loading.

6. The method according to claim 1, further comprising providing a buffer volume pipe loop, which is an extension of the multi phase fluid pipeline on the sea floor, and evacuating the liquid from the buffer volume pipe loop in a separate liquid evacuation pipeline.

7. The method according to claim 1, further comprising re-injecting the liquid in a controlled manner into the gas transport line through a liquid control device and further transporting the gas and the liquid in a common transport pipeline to a desired destination.

8. The method according to claim 1, further comprising re-injecting the gas into a liquid transport pipeline through a mixing device and further transporting it in a common transport pipeline to the desired destination.

9. The method of claim 5, wherein the buffer volume pipe loop is on the sea floor.

10. The method of claim 6, wherein the liquid evacuation pipeline is connected to the buffer volume pipe loop at a low point of the pipe loop.

11. The method of claim 1, wherein the desired destination is a selected downstream processing site.

* * * * *